United States Patent [19]

Fazzolari et al.

[11] Patent Number: 4,616,493

[45] Date of Patent: Oct. 14, 1986

[54] SHROUDED TRACK SLIDE BOLT

[76] Inventors: Anthony Fazzolari; Nicholas Fazzolari, both of 2205 Utica Ave., Brooklyn, N.Y. 11234

[21] Appl. No.: 582,374

[22] Filed: Feb. 22, 1984

[51] Int. Cl.[4] ..... E05B 65/06

[52] U.S. Cl. ..... 70/129; 70/371; 70/416; 70/417; 292/150; 292/DIG. 51

[58] Field of Search ..... 70/417, 371, 102, 104, 70/DIG. 6, 129, 416, 418; 292/148, 145–147, 149, 150–152, DIG. 51

[56] References Cited

U.S. PATENT DOCUMENTS

| | | | |
|---|---|---|---|
| 1,219,488 | 3/1917 | Rompf | 292/148 X |
| 1,490,578 | 4/1924 | Bachmann | 70/451 |
| 1,982,813 | 12/1934 | Jacobi | 70/371 |
| 2,103,987 | 12/1937 | Kistner | 70/451 |
| 2,117,715 | 5/1938 | Godfried | 70/417 |
| 3,190,683 | 6/1965 | Schlage | 292/337 |
| 3,599,453 | 8/1971 | Bauernfeind | 70/417 X |
| 3,740,980 | 6/1973 | Schimizzi et al. | 70/417 |
| 3,751,953 | 8/1973 | Newman | 70/381 |
| 3,752,520 | 8/1973 | Sprick et al. | 292/148 |
| 4,095,828 | 6/1978 | East | 70/417 X |
| 4,229,956 | 10/1980 | Thorburn | 292/148 X |
| 4,234,220 | 11/1980 | Finch et al. | 292/148 |
| 4,307,904 | 12/1981 | Daus | 292/148 |
| 4,362,035 | 12/1982 | Vitale | 70/416 X |
| 4,491,354 | 1/1985 | Williams | 70/417 X |

*Primary Examiner*—Gary L. Smith
*Assistant Examiner*—Lloyd A. Gall
*Attorney, Agent, or Firm*—Richard L. Miller

[57] ABSTRACT

A shrouded track slide bolt which is very difficult to breach including an anti-saw spindle inserted into the bolt where it bridges the gap between the door and the door jamb. If a saw is inserted into this gap the saw will stop cutting when it hits the anti-saw spindle which rotates freely. The mechanism consists of a fixed block and a sliding block with an attached dead bolt. If a saw is insertd into the gap between the blocks, a bolt collar will rotate making sawing impossible. At all other points the bolt is surrounded by massive case hardened steel blocks. A key system is provided so that a key is necessary to activate the bolt and the key may only be withdrawn if the bolt is fixed in either the fully extended or fully withdrawn position. A door jamb reinforcing insert is provided to strengthen the door jamb.

7 Claims, 8 Drawing Figures

SHROUDED TRACK SLIDE BOLT

BACKGROUND OF THE INVENTION

The present invention relates generally to high strength-high security door locks. At the current state of the art, the most secure type of lock is the dead bolt variety in which a strengthened bolt bridges the gap between the lock and the door jamb. Existing locks are subject to a number of shortcomings, however. One way of breaching a dead bolt lock is to saw through the bolt itself. The bolt is especially vulnerable where it breaches the gap between the lock and the door jamb. It is also vulnerable at any point along its length where it may exposed. Even if a lock is mounted on the inside of a door, it may be breached from outside by cutting a small hole in the door and sawing through any exposed area.

SUMMARY OF THE INVENTION

It is therefore a primary object of the present invention to provide a shrouded track slide bolt which leaves no length of dead bolt exposed without some form of protection. This is accomplished in the exposed section which bridges the gap between the lock and the door jamb by hollowing out the bolt and inserting an anti-saw spindle. If an attempt is made to saw through the bolt at this point, as soon as the spindle is reached, it rotates preventing any further damage to the integrity of the bolt. A similar system is currently in use on the bars of prison cells to prevent prisoners from sawing through their bars. The present invention consists of a sliding bolt permanently fixed to a sliding block. The bolt passes slidably through a fixed block. The movement of the sliding block and sliding bolt, then, are controlled by the fixed block and a block guide. The region of the bolt where the two blocks meet where the bolt is in the fully extended locked position could provide an area of vulnerability. Therefore, a rotatable bolt collar is used so that if an attempt is made to saw between the blocks, as soon as the saw contacts the rotatable bolt collar, this collar will rotate preventing any damage to the bolt. All other regions of the bolt are surrounded by massive hardened steel blocks.

A further object of the invention is to provide a key lock system to limit operation of the bolt to only those people who have a key. To this end a cylinder, key tumbler assembly and rotatable shaft are provided along with an associated key.

A yet further object is to reinforce the door jamb against the possibility of forced entrance by means of a crow bar. An associated door jamb reinforcing insert is provided for this purpose together with locking teeth to hold the reinforcer in position once it has been tapped into a pre-formed hole.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
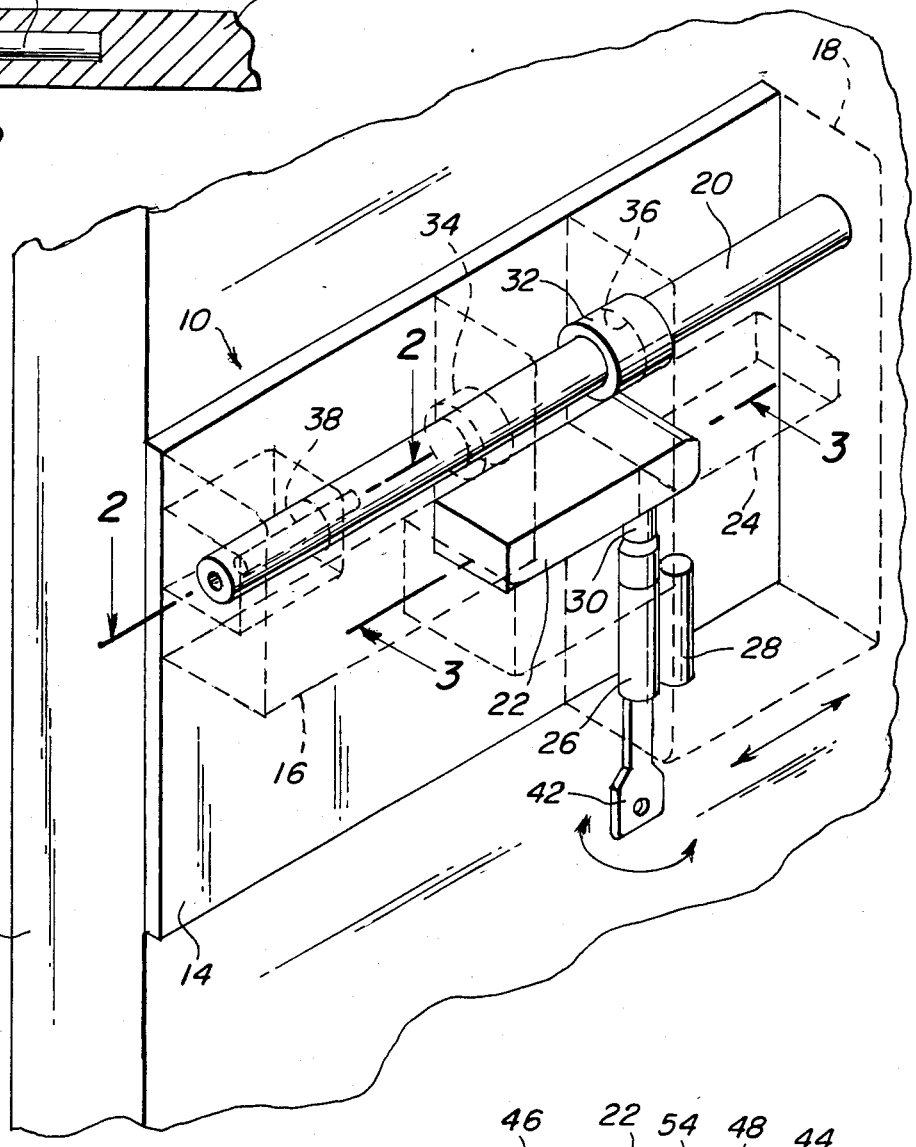
FIG. 1 is a perspective view of the invention mounted on a door in open position with housing shown in phantom in order to illustrate the internal mechanism.

FIG. 1 shows the invention 10 shown mounted on door 12. The invention 10 contains a steel plate 14 onto which is welded a fixed block 16. A large sliding block 18 and slide bolt 20 are welded together forming one strong integrated member. Slide bolt 20 slides freely through a hole in fixed block 16 so that lateral movement is permitted. Block guide 22 is also welded to steel plate 14 and is shaped and dimensioned so as to permit it to mate with sliding block channel 24.

A portion of sliding block 18 slides beneath the block guide 22 to support it. A cut out is provided in the bottom of block guide 22 through which cylinder 26, key tumbler assembly 28 and rotating shaft 30 may be inserted. Rotating shaft 30 engages block guide 22 in a manner which will be later described. To prevent breaching the bolt by means of sawing through between the blocks 16 and 18, a rotatable bolt collar 32 is mounted upon slide bolt 20 so that if a saw blade is inserted between blocks 16 and 18, once the blade contacts the collar the collar will simply rotate preventing any successful breach. Fixed block 16 and sliding block 18 are provided with bolt collar detents 34 and 36 so that blocks 16 and 18 may come into close contact in the bolt extended position yet still allow rotatable bolt collar 32 to rotate.

Figure 2:
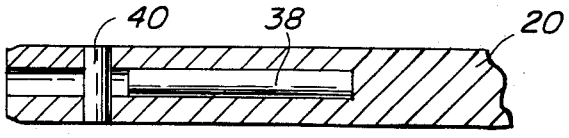
FIG. 2 is a cross sectional view taken on line 2—2 in FIG. 1.

In order to prevent breaching by sawing at the gap between the door 12 and the door jamb 62, the exposed section of the slide bolt 20 is hollowed out and anti-saw spindle 38 is allowed to rotate freely in the recess. This is shown in greater detail in FIG. 2 where a spindle locking pin 40 may also be seen which prevents spindle 38 from being lost.

FIGS. 3, 4, 5 and 6 show details of the mechanism necessary to maintain sliding bolt 20 in either a fixed open or fixed closed position by use of key 42. When key 42 is inserted into cylinder 26, then axially movable and rotating shaft 30 will move forward and rotate along with key 42. There are two round holes 46 and 48 in the bottom of block guide 22. Four locking pins 50, 52, 54 and 56 are inserted through openings in the side of block guide 22. Rotating shaft 30 has a shaft head which is shaped as a circle with opposing milled sides to provide opposing flat faces and an annular groove spaced from the end so that it may be inserted between locking pins 50 and 52 or between locking pins 54 and 56 and then moved axially forward and rotated so the pins are received in the groove which prevents the rotating shaft 30, key tumbler assembly 28 and cylinder from being withdrawn and fixes sliding block 18 and sliding bolt 20 in either a fully extended or fully retracted position. Cylinder 26 is designed so that key 26 may only be withdrawn when cylinder 26 and rotating shaft 30 are in the engaged position. This arrangement guarantees that when key 26 is removed slide bolt 20 is locked in either fully extended or fully retracted position and will not be free to move.

Figure 8:
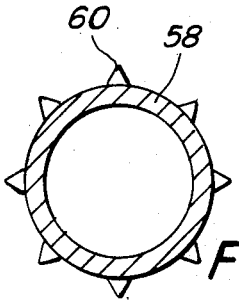
FIG. 8 is a cross sectional view taken on line 8—8 in FIG. 7.
Figure 3:
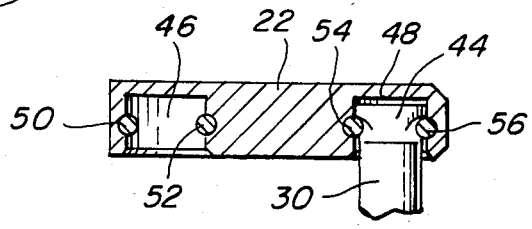
FIG. 3 is a cross sectional view taken on line 3—3 in FIG. 1.
Figure 7:
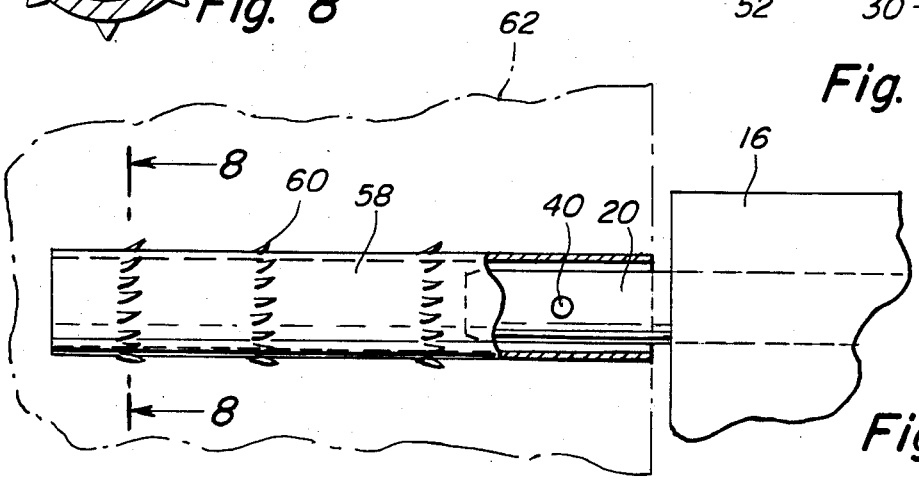
FIG. 7 is a partial cross sectional view of the sliding bolt partially inserted into the door jamb reinforcing insert.
Figure 4:
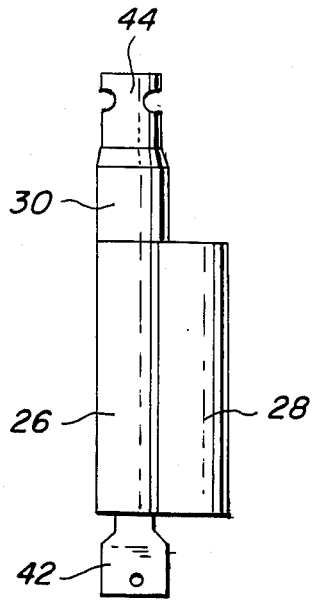
FIG. 4 is a front view of the cylinder, key tumbler assembly and rotating shaft.
Figure 5:
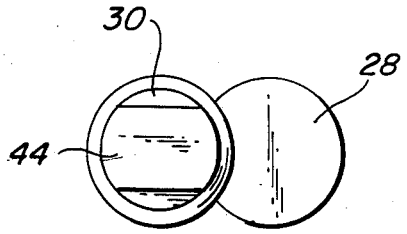
FIG. 5 is an enlarged top end view of the drawing in FIG. 4.
Figure 6:
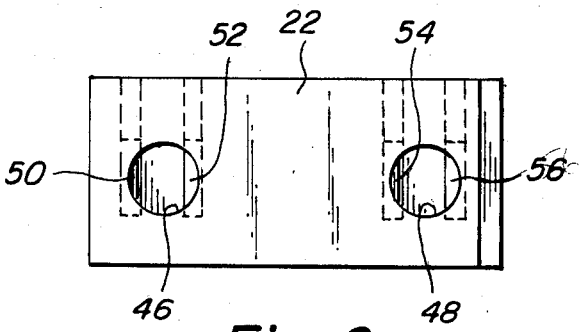
FIG. 6 is a bottom view of the block guide.

Since the weakest part of a door lock is often the door jamb itself, a door jamb reinforcing insert, 58 in FIGS. 7 and 8 is provided which may be tapped into a preformed hole in door jamb 62 and kept in place by means of locking teeth 60.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A shrouded track slide bolt comprising in combination a slide bolt, a housing for said slide bolt, said housing being split to include a fixed block and a laterally positioned sliding block, a rear portion of said slide bolt being permanently imbedded into said slide block, said fixed block acting as a bushing for slidably receiving a forward portion of said slide bolt, a steel support plate for affixing onto a door and fixedly supporting said fixed block and slidably supporting said sliding block, said sliding block being slidable between a retracted position laterally spaced from said fixed block wherein the slide bolt is retained within the fixed block and an extended position abutting the fixed block wherein the slide bolt projects from the fixed block, whereby in the vicinity of the door said slide bolt is completely shrouded within the housing in the extended position without any sliding handle attached to the slide bolt, a block guide securely fixed onto said support plate and received in the extended position within an accommodating mating channel in the sliding block, a pair of spaced apart lock receiving means in said block guide, lock means retained in said sliding block for selective insertion in one of said lock receiving means to selectively lock the slide bolt in a corresponding one of its extended and retracted positions, a rotatable collar around the portion of the slide bolt spanning said fixed and sliding blocks in the extended position, and corresponding annular detents formed in said fixed and sliding blocks for accommodating said rotatable collar, said rotatable collar preventing breach of said slide bolt by cutting through said slide bolt at the abutting faces of said fixed and sliding blocks.

2. A shrouded track slide bolt, as recited in claim 1 wherein said slide bolt is cylindrically shaped and constructed of case hardened steel.

3. A shrouded track slide bolt, as recited in claim 1, wherein said lock means further comprises a cylinder to which a key is inserted, a cooperating key tumbler assembly, and an axially movable rotating shaft in said cylinder which axially engages said lock receiving means in said block guide in either the extended or retracted position and means for preventing the removal of said key from said cylinder in any position other than that which causes said bolt to either be extended or retracted.

4. A shrouded track slide bolt, as recited in claim 3, wherein said lock receiving means are holes and wherein said shaft comprises a shaft head shaped as a circle with opposing sides milled away to form a pair of opposing flat faces which can fit between pins set into said holes in said block guide, and an annular groove formed about said shaft head for accommodating the pins so that ninety degree rotation of said rotating shaft from position of insertion to final position causes said shaft to become locked in said block guide in either a fully extended or fully retracted position.

5. A shrouded track slide bolt, as recited in claim 1, comprising an anti-saw spindle placed inside a hollow depression in said slide bolt where said slide bolt bridges the gap between the door and a door jamb so that if said bolt is sawed, when said saw reaches said anti-saw spindle, said spindle rotates preventing any further breech of said slide bolt.

6. A shrouded track slide bolt, as recited in claim 1, further comprising an associated door jamb reinforcing insert which may be tapped into a pre-formed hole and means for preventing the accidental removal of said door jamb reinforcing insert.

7. A shrouded track slide bolt, as recited in claim 6, wherein means for preventing the accidental removal of said door jamb reinforcing insert comprises a multiplicity of teeth placed in circumferential rows along the outer surface of said door jamb reinforcing insert.

* * * * *